US007811086B2

(12) United States Patent
Laaber et al.

(10) Patent No.: US 7,811,086 B2
(45) Date of Patent: Oct. 12, 2010

(54) FEEDING DEVICE FOR A BELT-TYPE SINTERING MACHINE

(75) Inventors: Karl Laaber, Dietach (AT); Oskar Pammer, Linz (AT); Hans Herbert Stiasny, Linz (AT)

(73) Assignee: Siemens Vai Metals Technology GmbH & Co (AT)

( * ) Notice: Subject to any disclaimer, the term of this patent is extended or adjusted under 35 U.S.C. 154(b) by 579 days.

(21) Appl. No.: 11/575,274

(22) PCT Filed: Jul. 12, 2005

(86) PCT No.: PCT/EP2005/007528

§ 371 (c)(1),
(2), (4) Date: Jun. 13, 2007

(87) PCT Pub. No.: WO2006/015680

PCT Pub. Date: Feb. 16, 2006

(65) Prior Publication Data

US 2008/0108006 A1 May 8, 2008

(30) Foreign Application Priority Data

Aug. 2, 2004 (AT) ..... A 1325/2004

(51) Int. Cl.
*F27B 9/38* (2006.01)

(52) U.S. Cl. ..... 432/239; 432/96; 432/149

(58) Field of Classification Search ..... 432/239, 432/149, 96, 97
See application file for complete search history.

(56) References Cited

U.S. PATENT DOCUMENTS 1,524,334 A * 1/1925 Brown ..... 193/16
3,185,635 A * 5/1965 Creglow ..... 75/318

FOREIGN PATENT DOCUMENTS

CN 1041215 A 4/1990
JP 2001 227872 A 8/2001
KR 2001060711 A * 7/2001
KR 2006073883 A * 6/2006

* cited by examiner

*Primary Examiner*—Gregory A Wilson
(74) *Attorney, Agent, or Firm*—Ostrolenk Faber LLP

(57) ABSTRACT

The invention relates to a feeding device for a belt-type sintering machine, with a feeding container for receiving the material to be sintered, with a conveying device for filling the feeding container with material to be sintered, with a feeding drum and a drum chute for feeding the material to be sintered onto the sintering belt. The feeding container has two discharge openings, one of which is connected to a feeding drum and one of which is connected to a feeding chute.

12 Claims, 2 Drawing Sheets

FEEDING DEVICE FOR A BELT-TYPE SINTERING MACHINE

The invention relates to a feeding device for a belt-type sintering machine, with a feeding container for receiving the material to be sintered, with a conveying device for filling the feeding container with material to be sintered, with a feeding drum and a drum chute for feeding the material to be sintered onto the sintering belt. The invention also relates to a method for feeding material to be sintered onto a sintering belt.

For economic reasons, the iron and steel industry is striving to keep increasing the productivity of sintering plants. For this purpose it is preferred—as one of several possibilities—to increase the thickness of the layer that is fed onto the sintering belt. Until a few years ago, layer thicknesses of approximately 300 to 350 mm were customary, and in some cases still are today. At present, however, sintering machines with layer thicknesses of up to 850 mm are also already being operated. This can only be achieved without reducing productivity if the permeability of the mixture is improved and/or the negative pressure in the suction system is increased.

With an increasing layer thickness, the use of coke also increases as the thickness becomes greater if parameters in the region of the feeding system otherwise remain unchanged. However, some of this coke would not be required for complete sintering through of the sintering bed, because the lower layers are in any case dried, warmed and finally strongly heated by the combustion gases sucked through the bed from above to below—even before they are ignited.

Increasing the layer thickness would therefore have the advantage that relatively less coke would be required—with respect to the overall amount sintered.

It has be attempted to solve this problem by feeding two layers of sintering material, the two layers each having a different coke content. However, it has only been possible to achieve this object inadequately by this variant. In addition, two separate mixing and feeding devices are required, which increases the expenditure on apparatus and servicing.

It has been recognized that the coke consumption can be reduced by classifying and segregating the fed sintering material in the vertical direction, it being required as a fundamental prerequisite that a consistently high sintering quality is to be maintained.

It is state of the art to equip existing feeding devices with classifying devices, which separate a large part of the coarse particles out of the raw sintering mixture and concentrate them in the lower region of the fed layer. However, special preparation of the solid fuel, in particular a reduction of the coarse grain fraction, is required for this.

It is further known in the case of a feeding device to design the drum chute in such a way that the mixing material segregation is achieved by the feeding operation. However, this does not allow great layer thicknesses to be achieved at the same time as good segregation.

JP 2001-227872 discloses a two-layer feed of sintering material via a feeding bunker with two discharge openings. The sintering material is charged into the feeding bunker in such a way that a segregation occurs in it. Each of the discharge openings is assigned a complete system comprising a feeding device, a feeding drum and a drum chute. Disadvantages of this variant are the high maintenance costs, and also a complicated and fault-susceptible control system for two feeding drums.

It is therefore the object of the present invention to develop the known state of the art further in such a way that high productivity can be achieved with high sintering layer thicknesses, a uniform high sintering quality and at the same time low coke consumption along with low maintenance costs and simple control.

The set object is achieved in the case of a feeding device for a belt-type sintering machine according to the precharacterizing clause of Claim 1 by the features of the characterising clause of Claim 1. The set object is also achieved in the case of a method according to the precharacterizing clause of Claim 9 by the features of the characterising clause of Claim 9.

The two discharge openings have the effect of dividing the feeding container into two regions, the material to be sintered being discharged from each of these regions predominantly through one of the two discharge openings in each case.

A segregation of the material to be sintered is brought about by the location of the charging of the material to be sintered into the feeding container. A pile with a slope forms in the feeding container. The gradient of the slope thereby corresponds to the average angle of repose of the charged material. The point of impingement of the material conveyed by the conveying device is chosen such that it comes to lie in the region which lies over the first discharge opening. The charged material can segregate itself along the slope thereby forming, i.e. coarse grain rolls down along the slope, fine grain remains at the top of the slope. Similarly, specifically lighter coke breeze tends to remain in the upper layer.

The material separated in such a way into coarse and fine grain is then discharged through the discharge opening assigned to the respective region and fed onto the sintering belt, to be precise the coarse grain in a free flow through a feeding chute directly onto the sintering belt or the bedding layer located on it, and the fine grain via a feeding drum and adjoining drum chute onto the layer of coarse grain already located on the sintering belt.

A feeding chute has the advantage over discharge of the coarse grain through a second feeding drum that the raw sintering mixture can run freely out of it and a defined layer height is always obtained once an arrangement and geometry of the feeding chute has been chosen. The surface of this layer is completely level and requires no further measures to produce a level surface. The agglomerates previously formed in a mixing and rolling device are not adversely affected during the free running-out from the feeding chute.

The layer of material to be sintered produced in this way has a grain size increasing from the top to the bottom. Surprisingly, the coke fraction in the pile also increases from the bottom to the top.

According to an advantageous embodiment, the conveying device is arranged in such a way that it achieves a point of impingement of the conveyed material at or near the end face of the feeding container.

As a result, the slope forming has a length which is as great as possible, so that particularly effective segregation of coarse and fine grain occurs.

The conveying device advantageously comprises a baffle plate for the directed dumping of the material to be sintered.

A baffle plate, which is configured for example as an obliquely running slide, facilitates precise charging of the material to be sintered at the desired point. According to one possible variant, the baffle plate may be fixedly connected to the conveying device; according to a further variant, the baffle plate is fixedly installed in the feeding container.

The conveying device may be variously designed. In particular, the conveying device comprises a pivoting conveyor or a pivoting chute or a transversely moving belt or a transverse conveyor, which can be made to move transversely in relation to the direction of movement of the sintering belt.

A pivoting conveyor is mounted rotatably about an axis in its rear region and, by rotation about this axis, can cover or fill the feeding container over its entire width. The filling thereby takes place parallel to the direction of movement and preferably also in the direction of movement of the sintering belt, so that the segregation inside the feeding container also takes place parallel to the direction of movement of the sintering belt. A segregation transversely in relation to the direction of movement of the sintering belt is undesired, because this would mean that coarse grain comes to lie at the edges of the sintering belt.

A pivoting chute is mounted rotatably about an axis—in a way similar to a pivoting conveyor. By contrast with the pivoting conveyor, however, in the case of the feeding chute the conveying operation takes place by gravitational forces.

A transversely moving belt is a short conveyor belt of approximately 5-8 metres in length which is arranged in such a way that its conveying direction is parallel to the direction of movement of the sintering belt. The transversely moving belt is charged with material to be sintered from one side, for instance by a transverse conveyor, or by a conveyor with a conveying direction which is likewise parallel to the direction of movement of the sintering belt, which material is dumped from the transversely moving belt at the desired point in the feeding bunker. The transversely moving belt is made to move, if appropriate together with the transverse conveyor or other conveyor, over the entire width of the feeding container, in order to ensure uniform material feeding.

The conveying device may also be formed by a transverse conveyor which can advantageously be made to move transversely in relation to the direction of movement of the sintering belt. The conveying device advantageously also comprises a baffle plate, the baffle plate either being fastened to the transverse conveyor or fixedly installed in the feeding container. The baffle plate is desirable in order to deflect the filling direction brought about by the transverse conveyor from "transversely in relation to the direction of movement of the sintering belt" into a filling direction "parallel to the direction of movement of the sintering belt". Otherwise, an undesirably high degree of segregation would occur transversely in relation to the direction of belt movement.

The conveying device is advantageously also able to move to an extent parallel to the direction of movement of the sintering belt, so that the grain size segregation can also be influenced by specific choice of the point of impingement.

In order to be able additionally to use the segregation brought about by the specific filling of the feeding container, the size and/or position of the second discharge opening can advantageously be changed.

For this purpose, the second discharge opening can advantageously be changed in size, for example by a slider. If the size of the discharge opening is changed by a slider, the central position of the discharge opening also changes, and with it also that proportion of the grain size spectrum which the material discharged from the feeding container through the discharge opening has.

As a result, the grain size composition of the coarse grain applied to the sintering belt can be influenced in an advantageous way.

In order to set the maximum amount of material to be sintered that can be fed per unit of time, the feeding chute can be pivoted about a horizontal axis and/or the feeding chute can be adjusted in the vertical direction and/or the size of the discharge opening of the feeding chute can be changed.

A feeding chute offers the possibility of keeping a layer thickness constant once it has been set without any further regulating intervention, without the risk of caked deposits and with an always level surface.

According to a further advantageously feature, a device for pre-warming the material fed onto the sintering belt is arranged between the feeding chute and the drum chute.

The device for pre-warming is advantageously formed with returned combustion gases or warmed air. This device has the purpose of warming the material to be sintered, which has a moisture content of about 5 to 7%, in order that the total required amount of heat to be provided thereafter is lower. Similarly, the condensation of water vapour on the lower layer during the later sintering operation is reduced. If appropriate, the material to be sintered may also be pre-dried by the device for pre-warming. If desired, other gases may also be introduced into the material to be sintered by means of this device.

According to a further embodiment, the feeding device according to the invention has a probe, with the aid of which the thickness of the layer fed onto the coarse grain layer through the feeding drum and the drum chute is measured. This probe is used to control the feeding rate of the feeding drum if the measured layer thickness deviates from a preset desired value.

There is no need for the layer height of the coarse grain layer to be checked separately, because—once it has been set—the thickness of this layer remains constant because of the feeding by means of a feeding chute.

The invention also relates to a method for feeding material to be sintered onto a sintering belt according to the precharacterising clause of Claim 9. The object set according to the invention is achieved in the case of this method by the features of the characterising clause of Claim 9.

The invention is explained in more detail below in the drawings of FIG. 1 to FIG. 2.

Figure 1:
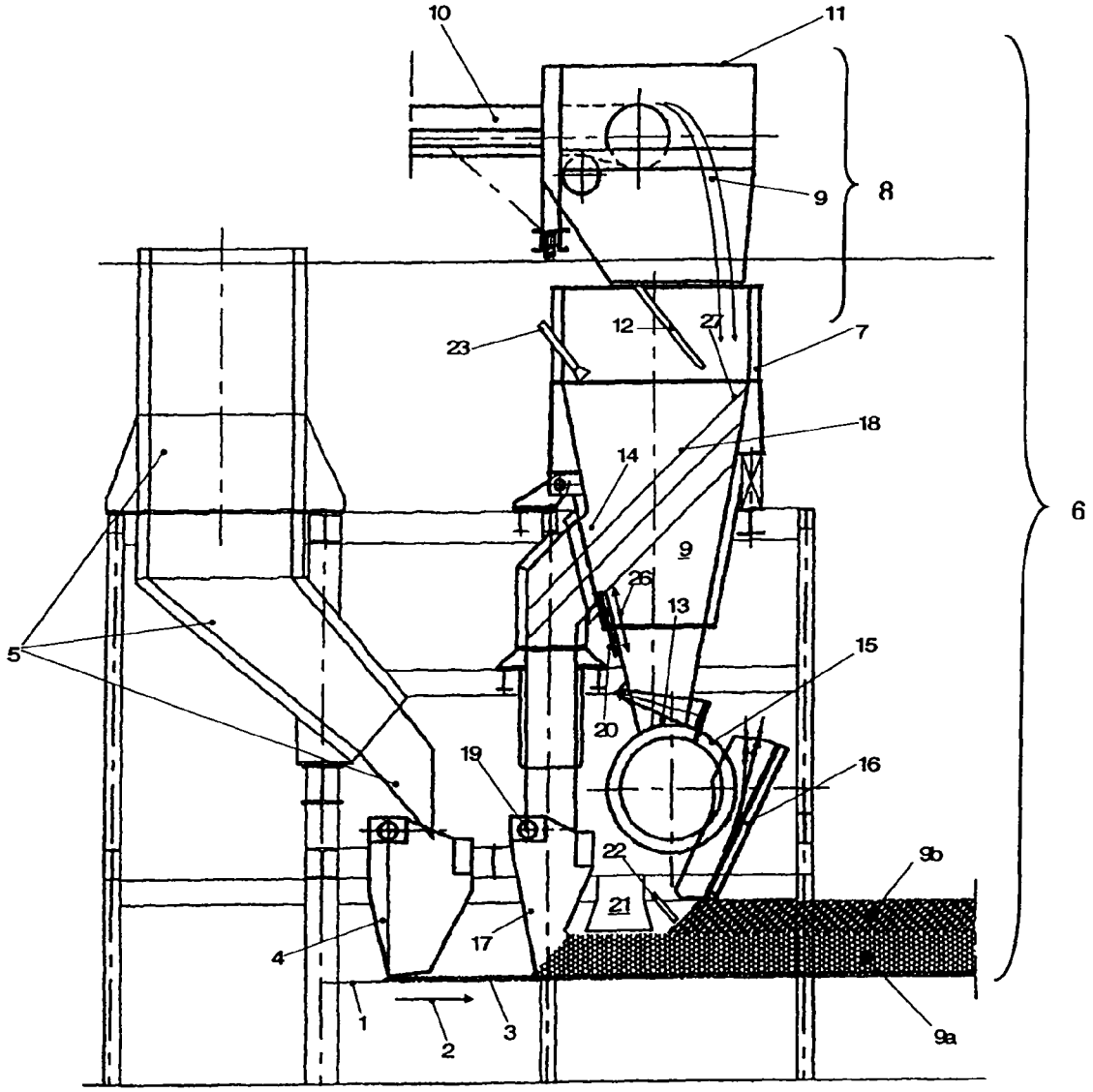
FIG. 1 shows a feeding device according to the invention.

In FIG. 1, bedding layer 3 is fed via a chute 4 onto the grid of a sintering belt 1, which is moved in the direction of the arrow 2. The feeding device 6 according to the invention is arranged downstream of the device 5 for feeding bedding layer 3, in the belt running direction 2. Material 9 to be sintered is filled into the feeding container 7 via the conveying device 8. The conveying device 8 comprises a pivoting conveyor 10, an enclosure 11, and also a baffle plate 12 for the exact positioning of the point of impingement 27 of the conveying device.

The feeding container 7 has two discharge openings 13, 14, the material 9*b* that is flowing out via the first discharge opening 13 being fed by a feeding drum 15 and an adjoining drum chute 16 onto the sintering belt 1, or onto the material 9*a* already located on it.

The material that is flowing out of the second discharge opening 14 is fed by means of the feeding chute 17, adjoining the second discharge opening 14, onto the sintering belt 1, or onto the bedding layer 3 already located on it.

The choice or positioning of the point of impingement 27 of the conveying device 8 has the effect that a slope 18 forms in the feeding container 7. The material 9 to be sintered, which is generally fed onto the slope 18 as near the top as possible, segregates itself along this slope 18.

The second discharge opening 14 is positioned in such a way that predominantly coarse grain is discharged through it, or at least a greater fraction of coarse grain than is the case for the first discharge opening 13.

In the case of the feeding chute 17 represented in FIG. 1, there is no change of the thickness of the material fed by it—without further regulating intervention—throughout the entire charging operation. In order that the thickness of the coarse grain layer can be pre-set, the feeding chute 17 can be pivoted about an axis 19. Alternatively or in addition to this, the vertical position of the feeding chute 17 can also be changed (vertical setting possibility not represented).

Sliders 20 are provided at the second discharge opening 14 as a further setting possibility, to be precise in order to influence the range of the grain band which flows out through the second discharge opening 14. The cross section of the second discharge opening 14 can be varied by movement of the slider 20 in the direction of the arrow 26.

Arranged between the feeding chute 17 and the drum chute 16 is a pre-warming hood 21, which serves for pre-warming the coarse grain fraction fed onto the sintering belt 1.

Also provided is a probe 22, by means of which the layer thickness of the fine grain fraction is measured. If there is a deviation from a desired value, the operating speed of the feeding drum is changed correspondingly. A suitable probe 22 may be configured as an ultrasound probe. A suitable probe 22 may also be formed by at least two sensors of different lengths, one of which must always be immersed in the pile. If both or neither of the sensors is/are immersed, an intervention is made to regulate the operating speed of the feeding drum. As already explained, there is no need for the layer thickness of the coarse grain fraction to be regulated.

A further probe 23 is provided, by means of which the filling level in the feeding container is checked, an intervention being made to regulate the conveying rate of the material delivered by the conveying device if there is a deviation from a desired value. A suitable probe 23 is preferably configured as an ultrasound probe.

Figure 2:
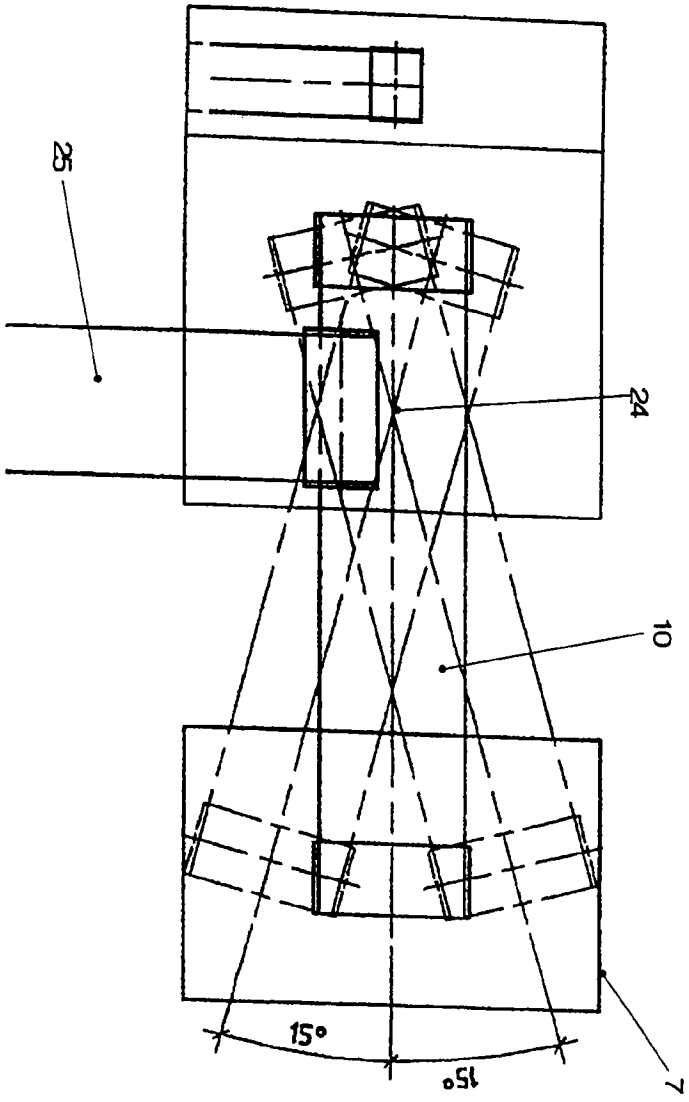
FIG. 2 shows a pivoting conveyor used for the feeding device in plan view.

The pivoting conveyor 10 represented in FIG. 2 can be pivoted horizontally about an axis of rotation 24. This allows the pivoting conveyor 10 to pass over and fill the feeding container 7 in the entire width. The material to be sintered is fed onto the pivoting conveyor 10 in the proximity of the axis of rotation 24 by means of a conveyor belt 25.

The invention claimed is:

1. Feeding device for a belt-type sintering machine, the device comprising:

a feeding container configured for receiving material to be sintered, the feeding container including a first and second discharge openings;

a sintering belt;

a feeding chute connected to the second discharge opening of the feeding container and configured to feed the material to be sintered from the second discharge opening onto the sintering belt;

a feeding drum with a drum chute, the feeding drum being connected to the first discharge opening of the feeding container and configured to feed the material to be sintered from the first discharge opening onto the sintering belt; and a conveying device connected to the feeding container and configured to fill the feeding container with the material to be sintered, the conveying device having a point of impingement of the material to be sintered, the point of impingement lying in an area of the feeding container that is located over the first discharge opening, and the second discharge opening being positioned in a lower region of an area of the feeding container located opposite from the point of impingement.

2. Feeding device according to claim 1, wherein the feeding container includes an end face and the conveying device is arranged such that the point of impingement is at or near the end face of the feeding container.

3. Feeding device according to claim 2, wherein the conveying device comprises a baffle plate for directed dumping of the material to be sintered.

4. Feeding device according to claim 1, wherein the conveying device comprises a baffle plate for directed dumping of the material to be sintered.

5. Feeding device according to claim 1, wherein the conveying device comprises at least one of a pivoting conveyor, a pivoting chute, a transversely moving belt and a transverse conveyor.

6. Feeding device according to claim 1, wherein at least one of a size and a position of the second discharge opening can be changed.

7. Feeding device according to claim 1, wherein the feeding chute is pivotable about a horizontal axis to set a maximum amount of the material to be sintered to be fed per unit of time.

8. Feeding device according to claim 1, further comprising a pre-warming device operable for pre-warming the material fed onto the sintering belt, the pre-warming device being arranged between the feeding chute and the drum chute.

9. Feeding device according to claim 1, further comprising a probe configured and operable for controlling a feeding rate of the feeding drum.

10. Feeding device according to claim 1, wherein the feeding chute is adjustable in a vertical orientation to set a maximum amount of the material to be sintered to be fed per unit of time.

11. Feeding device according to claim 1, wherein a size of a discharge opening of the feeding chute is changeable to set a maximum amount of the material to be sintered to be fed per unit of time.

12. A method for feeding material to be sintered onto a sintering belt, the method comprising the steps of:

introducing the material to be sintered into a feeding container;

segregating the material to be sintered into a coarse and fine grain in the feeding container; and feeding the material to be sintered from the feeding container onto a sintering belt, including discharging the coarse grain from the feeding container via a feeding chute;

discharging the fine grain from the feeding container via a feeding drum; and feeding the coarse grain and the fine grain onto the sintering belt at locations that are separate from each other, wherein the step of introducing the material to be sintered into the feeding container includes dumping the material to be sintered into an area of the feeding container located over a discharge location of the fine grain, and the step of discharging the coarse grain takes place at a lower end of a slope formed by the material to be sintered.

* * * * *